US005986199A

United States Patent [19]

Peevers

[11] Patent Number: 5,986,199

[45] Date of Patent: Nov. 16, 1999

[54] DEVICE FOR ACOUSTIC ENTRY OF MUSICAL DATA

[75] Inventor: Alan W. Peevers, Santa Cruz, Calif.

[73] Assignee: Creative Technology, Ltd., Singapore, Singapore

[21] Appl. No.: 09/093,850

[22] Filed: May 29, 1998

[51] Int. Cl.[6] ..... G10H 7/00

[52] U.S. Cl. ..... 84/603

[58] Field of Search ..... 84/600, 603

[56] References Cited

U.S. PATENT DOCUMENTS

| | | | |
|---|---|---|---|
| 4,463,650 | 8/1984 | Rupert | 84/616 X |
| 4,591,928 | 5/1986 | Bloom et al. | 360/13 |
| 4,829,872 | 5/1989 | Topic et al. | 84/453 |
| 4,885,790 | 12/1989 | McAulay et al. | 381/36 |
| 5,054,072 | 10/1991 | McAulay et al. | 381/31 |
| 5,287,789 | 2/1994 | Zimmerman | 84/477 R |
| 5,351,338 | 9/1994 | Wigren | 395/2.28 |
| 5,367,117 | 11/1994 | Kikuchi | 84/603 |
| 5,504,269 | 4/1996 | Nagahama | 84/609 |
| 5,608,713 | 3/1997 | Akagiri et al. | 369/124 |
| 5,666,299 | 9/1997 | Adams et al. | 364/724.011 |
| 5,792,971 | 8/1998 | Timis et al. | 84/603 X |

OTHER PUBLICATIONS

Satoshi Imai, *Cepstral Analysis Synthesis on the MEL Frequency Scale*, Proceedings: IEEE International Conference on Acoustics, Speech and Signal Processing, vol. 1, 93–96 (1983).

Mark Dolson, *The Phase Vocoder: A Tutorial*, Computer Music Journal, vol. 10, No. 4, 14–27 (Winter 1986).

Piero Cosi, *Timbre Characterization with Mel–Cepstrum and Neural Nets*, ICMC Proceedings: Psychoacoustics, Perception, 42–45 (1994).

Muscle Fish StudioPal™ Description, Features, and Specifications at http://www.musclefish.com/studiopal.desc.html, 1993.

Tadashi Kitamura, *Speech Analysis–Synthesis System and Quality of Synthesized Speech Using Mel–Cepstrum*, Electronics and Communications in Japan, Part 1, vol. 69, No. 1, 47–54 (1986).

*Primary Examiner*—Jeffrey Donels
*Attorney, Agent, or Firm*—Townsend and Townsend and Crew LLP

[57] ABSTRACT

A method and apparatus for vocally entering acoustic data and producing an output. In one embodiment, a note preset is identified and selected according to the vocal input signal, and auxiliary note information is also extracted from the vocal input signal. The auxiliary note information is used to generate synthesis engine parameters that modify the note preset to provide a complex note output. In another embodiment, feature vectors of note segments are used to select a preset file representing a particular instrument from a library of instrument preset files. A note preset is selected from the instrument preset file according to the note segment to create an output corresponding to the selected instrument or instrument group.

21 Claims, 3 Drawing Sheets

DEVICE FOR ACOUSTIC ENTRY OF MUSICAL DATA

BACKGROUND OF THE INVENTION

The present invention relates to a method and apparatus for entering musical data directly using audio input, and more particularly to the creation of an audio composition from acoustic information sung into a microphone by a composer.

Composers have traditionally created musical compositions by having several musicians learn the various parts of the composition according to the composer's instructions, and then play all the instruments simultaneously to produce the composition. Changes to the composition were time consuming and difficult, often requiring successive performances of the entire composition. Multi-track recording techniques allowed composers to record each musical part independently, and to superimpose each instrument's part onto a master recording. This technique allowed, among other things, a composer to play each instrument himself or herself, and to change individual tracks without having to re-generate the other parts. Early multi-track recording typically involved an elaborate sound recording facility. More recently, digital audio techniques have simplified the composer's task.

Music that is played on an instrument or heard with the ear is in an analog form. This analog form may be converted into a digital form, often with no loss of fidelity because the digital sampling rate, can be much higher than the highest frequency the human ear can hear. Once in digital form, the music may be manipulated or transformed in a variety of ways. For example, it may be compressed so that a long audio piece may be transmitted to another destination in a short period of time, and then expanded to reproduce the original audio sound, or, the pitch or other characteristics of the audio signal may be changed. Digital techniques may also be used to store audio information from various sources and then combine them to form a composition, similar to a multi-track tape recorder.

Modern day composers typically use a music keyboard or similar device to enter music into a digital audio device, such as a computer or digital mixing board, using traditional piano-playing techniques. Some keyboards can be configured to mimic various standard musical instruments, such as a flute or piano, allowing the composer to compose a piece without the need for the actual musical instrument, and without even needing to know how to play a particular musical instrument, as long as the composer can enter the desired notes through the keyboard. Unfortunately, entering notes through a keyboard often does not provide the audio complexity a composer would like to achieve. The mechanical gestures involved with entering notes on a keyboard or other input device, such as a wind controller, guitar controller, or percussion controller, typically do not capture the auxiliary information associated with a particular note. For example, there is no intuitive way to perform a tremolo via a piano-type music keyboard. Typically, this sort of information is added later in the compositional process, after the initial note entry.

Therefore, it would be desirable to provide an integrated compositional device that could produce a musical composition using a composer's voice as a unified input for entering notes and associated auxiliary information. It would be further desirable that such a device could be portable to allow compositions to be created in any location the composer chose, and that the device could play the compositions back, so that the composer could listen to and subsequently modify the compositions.

SUMMARY OF THE INVENTION

By virtue of the present invention a method and an apparatus for creating musical compositions using vocal input is provided. In one embodiment, an integrated apparatus converts notes sung by a composer in acoustic form into a digital signal. The digital signal is separated into segments by a processor and the segments are converted into a sequence of notes stored in a memory to produce a note output. The note output is provided to a synthesizer that creates a digital output signal, which is converted by a DAC and played on an integrated speaker.

In another embodiment, auxiliary note data is extracted from the segments to create synthesizer engine parameters. The synthesizer engine parameters are combined with the note output to provide a modified digital output signal, such as would apply vibrato or tremolo to the note.

In another embodiment, the segments are mapped onto an instrument file, also known as a "preset" file, and the synthesizer produces a note output characteristic of the selected instrument. In a further embodiment, the preset file is chosen from a preset library stored in memory according to a feature vector set of the segment.

A further understanding of the nature and advantages of the invention herein may be realized by reference to the remaining portions of the specification and the attached drawings.

DESCRIPTION OF THE PREFERRED EMBODIMENTS

The following description makes reference to functional diagrams that depict various elements, such as digital signal processors (DSPs), read-only memories (ROMs), and wavetable synthesizers. However, the present invention may be implemented in a variety of hardware configurations, or in software. For example, a DSP could be implemented by configuring a general purpose computer processor with appropriate software, and a wavetable or other type of synthesizer could also be implemented in a central processor if the processor had sufficient processing capacity. Similarly, a ROM could be substituted with a portion of a write/read memory configured from a disk.

The present invention provides a method and an apparatus for creating musical compositions from a vocal input. Some conventional methods enter music into a computer or synthesizer via a keyboard using traditional piano-playing techniques. Entering notes in such a mechanical fashion limits the complexity of information that can be entered. The human voice has the capability to mimic many complex sounds in a fashion that includes not only the note information, but also variations in pitch and amplitude, including simultaneous variations in pitch and amplitude. These complex sounds may be re-generated for the composer to listen to, or may be synthesized to recreate the sounds of a particular instrument. The composer may enter many parts, or tracks, of composition into the apparatus through a single input. The apparatus will be called a "composer's assistant" for the purpose of this application.

Figure 1:
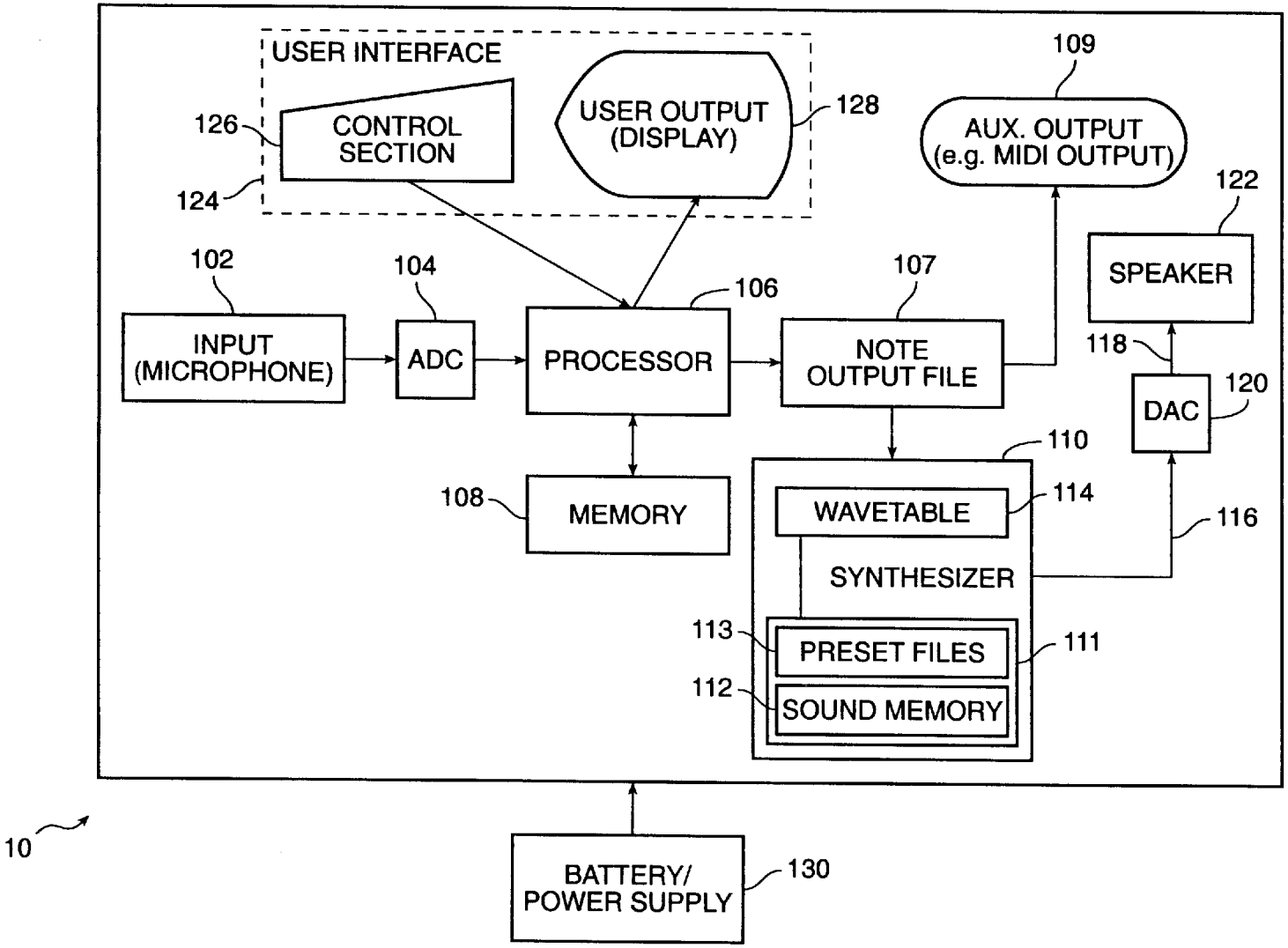
FIG. 1 depicts a simplified block diagram of a composer's assistant according to an embodiment of the present invention.

FIG. 1 shows a simplified block diagram of a composer's assistant 10. A single input 102, such as a microphone, is used to acquire vocal information from the composer (not shown), who sings, hums, or otherwise vocalizes a musical part. An analog-to-digital converter (ADC) 104 converts the analog electric signal produced by the microphone into a digital audio input. A processor 106, such as a DSP or microprocessor, processes the digital audio input to extract note information. The operation of the processor will be described in further detail below. The processor operates according to instructions provided by a computer program stored in memory 108. The computer program may be stored in an installed memory, such as ROM, or may be loaded from other computer-readable medium, such as a diskette, a CD-ROM, or downloaded from a hard disk into RAM or other local computer-readable storage media.

After segmenting the digital audio input into note segments, the processor extracts information from them to produce note parameters, such as average pitch, pitch contour, average amplitude, amplitude contour, note-on velocity, and similar parameters. This process is not a mere digitization of the composer's voice into a digital file, rather the process map the sung notes to a tuning scale (e.g. equal tempered) and returns note output information including pitch and velocity, such as in a musical-instrument-digital-interface, (MIDI) note. The note outputs are accumulated to form a note output file 107, such as a MIDI file. The note output file can be output 109 as a MIDI output, for example, or stored on a disk, in RAM, or other medium, and/or converted to an audio output. Conversion of the note output file to a digital output signal is done with a synthesizer 110, such as a wavetable synthesizer. The synthesizer 110 may include an instrument library 111, that includes a sound memory 112 and preset files 113 that provide a library of note information, such as presets and digital audio data for specific instrument sounds, to the wavetable 114. The note output file information is used to select presets and elements in the sound memory which are then loaded into the synthesizer. The sound memory may be incorporated into the synthesizer, may be stored in system memory, including a system disk or ROM, or may be read from other computer-readable media, such as from a diskette or ROM card or CD-ROM. FIG. 1 shows the sound memory 112 as part of the synthesizer 110 for illustration purposes. The synthesizer produces a digital audio output 116 from the note output file, which is converted to an analog audio output 118 by a digital-to-analog converter (DAC) 120. A speaker 122 plays the analog audio output for the composer to hear. Many of the above functions could be implemented by programming a sufficiently powerful processor. For example, the processor could be programmed to perform as a synthesizer, thus making a stand-alone synthesizer unnecessary.

Software stored in memory 108 configures the DSP to implement the functionality of a multi-track sequencer. Multi-track sequencing allows the user to record a complete composition by singing in the separate parts one at a time, where each part is assigned to a different track. Once one or more tracks have been entered into the sequencer, the sequenced data is exported via a MIDI file and/or provided to the synthesizer.

A user interface 124 allows the composer to control the operation of the sequencer through a control section 126 that includes, for example, buttons and switches, and provides the composer with information about the sequencer through a display section 128 that includes, for example, a liquid-crystal display (LCD) and light-emitting diodes (LEDs). Through the user interface 124, the composer can select a track, rewind a track, rewind the entire composition, play a track or the composition, etc.

In one embodiment, the input, control section, display, processor, synthesizer, speaker, and other components are integrated into a portable, hand-held unit. This unit could be powered by a battery 130 or similar power supply to allow a composer to create a composition in a variety of locations. Specifically, it allows a composer to compose at the site where a composer may hear or imagine a particular sound or music that the composer wants to capture or build upon in his composition rather than returning to the artist's studio. Sometimes an idea may be lost or blurred en route. An integrated, portable composer's assistant provides this opportunity, whereas conventional multi-track recording devices require access to a power outlet and a significant amount of time to set-up and configure. However, providing such a portable composer's assistant is not merely a matter of powering the device with a battery.

One problem that arises when producing a multi-track composition from a single input is synchronizing the various tracks. With tape recorders, the tape is physically re-wound to a starting point. The composer's assistant identifies the beginning of a track and essentially instantly digitally "re-winds" the sequencer to the proper location for entry of the second and subsequent tracks to achieve a similar, but superior, result to a multi-track tape recorder. It is superior because the queuing is done instantaneously and automatically. In one embodiment, a second track is queued to a first track when the composer begins entering the second track. This speeds the compositional process and frees the composer from the task of managing a cumbersome, multi-input mixing board or managing multiple input devices (microphones). It is so simple to operate, that the composer need indicate only that a second track is being recorded. Of course, the second track may be entered with a timed offset to the first track, or entered at user-designated markers associated with the first track.

Figure 2:
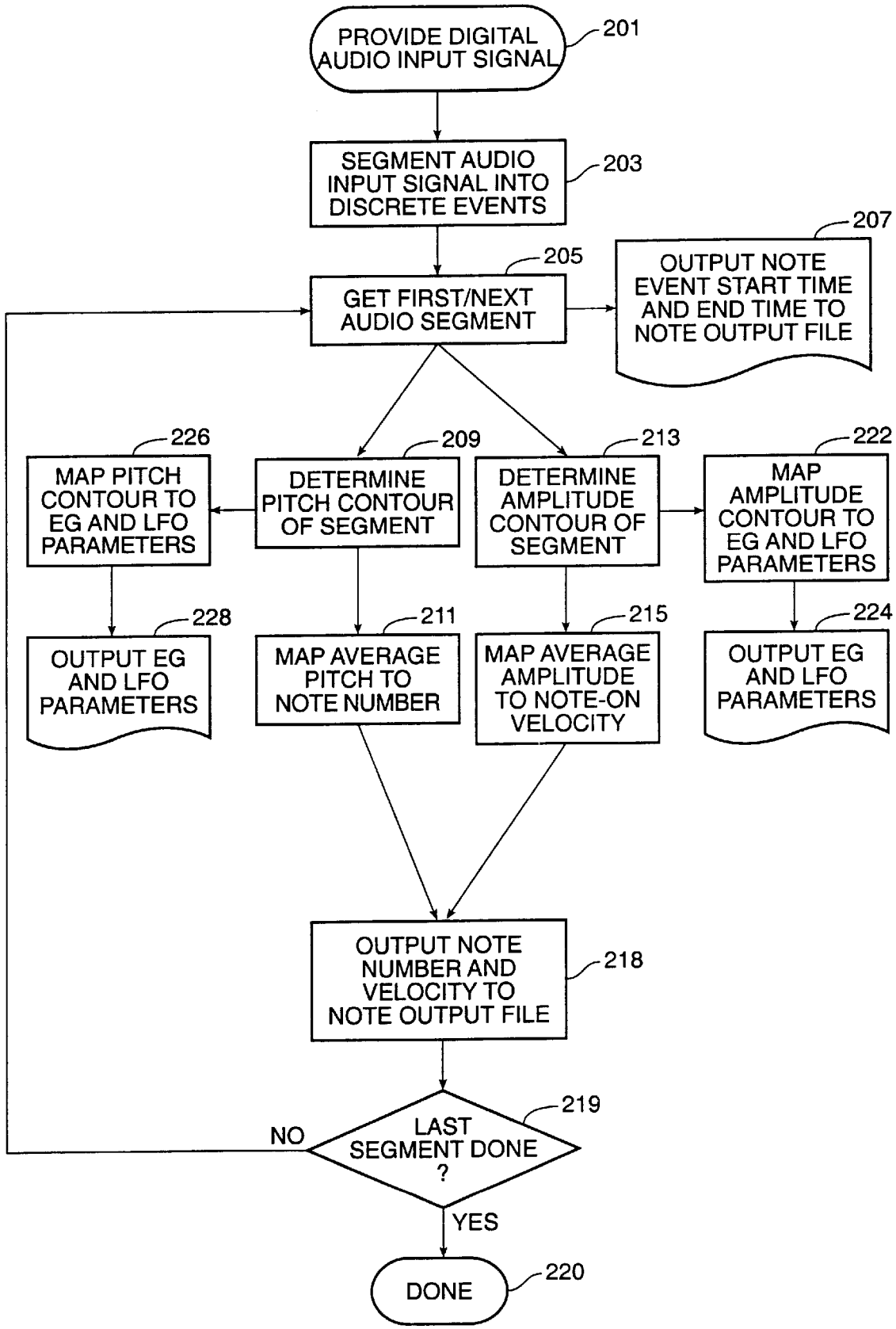
FIG. 2 is a simplified flow chart of a method of a technique for processing an input signal into a note file with auxiliary data.

FIG. 2 is a simplified block diagram of one technique a DSP could use to process a digital audio input signal into a note file of separate notes with auxiliary data. An audio input signal is provided (step 201) to a pitch detector. The pitch detector identifies rapid transitions in the pitch trajectory to break the digital audio input signal into segments (step 203), although other methods of identifying notes could be used. Transitions can be located by detecting when the output of a high-pass filtered pitch track exceeds a threshold value. The robustness of the segmentation process is improved by searching an amplitude envelope for rapid variations in instantaneous amplitude, and matching those locations in the amplitude envelope with the transitions in the pitch track. Additional criteria may be used, and weighting factors may be applied to the criteria to estimate the segment boundaries.

Once a segment, or event, has been identified (step 205), a beginning time stamp and an ending time stamp for the event is placed in an output buffer (step 207). The sequencer will subsequently read the data in this output buffer, or memory, to determine when to initiate and terminate notes. A segment is then provided to a pitch estimator, which produce a series of estimates of the time-varying fundamental frequency, or "pitch contour", of the segment (step 209).

A typical segment will not have an ideal fixed pitch, but will fluctuate around some nominal pitch value. For this reason, the pitch estimator has the capability to smooth the pitch contour by replacing a series of pitch estimates for the segment with a single number representing the average of all the pitch estimates. This average pitch estimate can then be mapped to the nearest equal-tempered scale degree (step 211), and the corresponding note number, such as MIDI note number. This information is placed in the note output file (step 218).

It is understood that alternate tuning methods are possible, and that methods could be used to correct or alter the pitch of the input, for example, if the user tends to sing flat. Additional information, such as the key signature the music is in, can also be used to assist in the note determination process.

An amplitude envelope estimator also receives the segment of the digital audio input signal. The amplitude envelope estimator produces a series of estimates of the time-varying amplitude, or amplitude contour, of the signal (step 213). A short-duration root-mean-squared (RMS) amplitude measurement technique operates on a series of digitized values of the input segment. The equation that describes the technique is:

$$E(nT) = \left( \frac{1}{T} \sum_{i=nT-T/2}^{nT+T/2} x^2(i) \right)^{1/2} \qquad \text{Eqn. 1}$$

Where T is some predetermined frame size dependant on how often a new estimate is needed, X(n) is the series of digitized audio values of the input segment, and E(nT) is the RMS estimate for the frame. Typically, T is about 10–50 msec (e.g. 80 samples at an 8 kHz sample rate). Once an envelope has been estimated, the envelope values can be averaged to arrive at a single number that represents the loudness of the note. This loudness number is then mapped to a velocity, such as MIDI velocity between 0–127, (step 215) and placed in the note output file (218). It is understood that the buffer may be segmented or arranged in a variety of ways, and that whether it is physically the same memory device as buffers used to store other information is a choice of the designer. This data buffer is read by the sequencer to determine the amplitude of the notes it initiates A determination is made as to whether there are more segments to process (step 219). If there are no more segments to process, the process is finished (step 220).

The mapping of RMS amplitude to MIDI velocity can be accomplished via a table to allow different expressive interpretations of the audio input. For example, a table that approaches value 127 quickly would map most note segments to loud MIDI velocities, thus resulting in a louder interpretation of the performance.

Additional features are incorporated that enhance the utility of the note identification and generation technique. Specifically, these features allow mapping different sung timbres to different MIDI instruments by mapping pitch and amplitude contours onto synthesis engine parameters and feature recognition parameters. This processing captures more of the expressive characteristics of the performance that is represented by the sung audio input.

For example, a vibrato sung by a singer can be modeled by a combination of low-frequency oscillators (LFOs) and envelope generators (EGs). The LFOs and EGs both operate on the pitch and amplitude of the input signal. The LFOs and EGs are typically available in a wavetable synthesis architecture. Using an LFO to modulate the pitch and amplitude of the synthesizer makes it possible to capture the essence of the vibrato. The amplitude contour could be mapped to amplitude EG and LFO parameters (step 222) which is then output to the buffer (step 224). Similarly the pitch contour could be mapped to pitch EG and LFO parameters (step 226), which are also output to the buffer (step 228). When it is desired to listen to or otherwise output the composition, the LFO, EG, and note outputs are recalled from the buffer and combined to synthesize the note. This synthesis may be timed according to associated event start and stop times output and stored in step 207. Additionally, several tracks may be stored at different times to be synthesized simultaneously, and an input for a track may be processed and stored concurrently with the output of a previous track or tracks to result in a synchronous multi-track composition.

Figure 3:
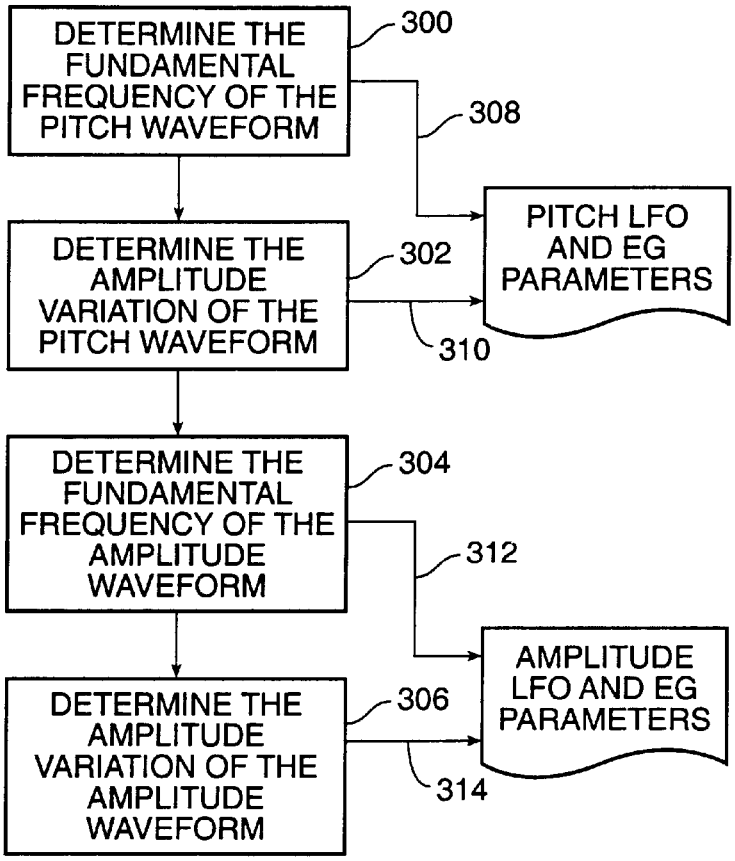
FIG. 3 is a simplified flow chart of an exemplary method for generating low-frequency oscillator control parameters.

FIG. 3 is a simplified flow chart of a mapping procedure for generating LFO and EG control parameters. The following is an example of steps for generating LFO and EG control parameters:

(a) Determine the fundamental frequency of the pitch waveform (step 300). This can be done using a fast-Fourier transform (FFT) or an autocorrelation calculation, for example. This step determines the frequency at which the pitch LFO will modulate the pitch, and outputs to the pitch LFO and EG parameters buffer (step 308).

(b) Determine the amplitude of the variation in the pitch waveform (step 302). This can be done using an RMS measurement technique, as described above. This step determines the amount of modulation, if any, that the pitch LFO will apply to the pitch of the note and also outputs to the pitch LFO and EG parameters buffer (step 310). It should be noted that the pitch EG parameters can be estimated in a similar way, for example, to represent a rising pitch or glissando.

(c) Determine the fundamental frequency of the amplitude waveform (step 304). This may be done with methods similar to those used in step (a), and often this parameter is the same as the parameter established in step (a), in which case this step may be skipped. This step determines the frequency at which the amplitude LFO will modulate the amplitude, and outputs to the amplitude LFO and EG parameters buffer (step 312).

(d) Determine the amplitude of the variation in the amplitude waveform (step 306). This can be done as in step (b); however, it is done separately because the resulting value typically differs from the variation in the pitch waveform. The amplitude of the variation in the amplitude waveform determines the extent, if any, to which the amplitude of the note is modulated by the amplitude LFO and also outputs to the amplitude LFO and EG parameters buffer (step 314).

An output to control manipulation of the preset is provided at each step of the analysis. Some waveforms may not have particular attributes, resulting in a null output for that step. The LFO and EG pitch and amplitude outputs are provided to the LFO(s) and EG(s), which can modify the preset output. The preset output may be a simple note associated with a particular source (instrument), or may be a complex note with note attributes. The overall amplitude evolution of the note can also be mapped to an envelope generator unit. This unit is typically controlled with parameters such as attack time, decay time, sustain level, and release time (collectively known as "ADSR"). These four parameters, for example, can be estimated by using a least squares technique to find the best fit of the ADSR parameters to the actual amplitude envelope.

Additional features can be extracted from the audio waveform to allow selection from a set of sounds by finding those sounds that most closely match the extracted features. In other words, the input signal is classified according to its acoustic feature set, and a similar preset is selected.

Figure 4:
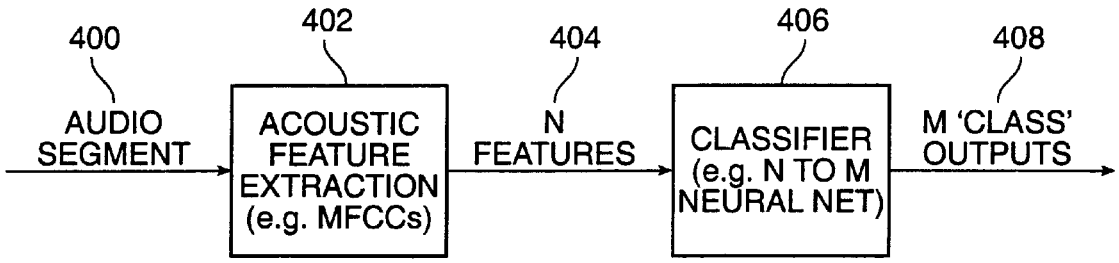
FIG. 4 is a simplified block diagram of an apparatus for classifying sounds.

FIG. 4 is a simplified block diagram of an apparatus for classifying sounds. A number of different features could be used to classify the incoming audio segment 400, such as the feature set known as the Mel-Frequency Cepstral Coefficients (MFCCs), which have been found to effectively capture many perceptual qualities of a sound. Other features can be used alternatively, or in addition, to the MFCCs, such as pitch, spectral centroid, attack time, duration, harmonicity, loudness, brightness and spectral peaks. The acoustic feature extraction unit 402 extracts a set of N features 404 and provides this information to a classifier 406. The classifier could be a neural net, for example, that uses standard training techniques to build up a mathematical model that relates the input to the output. When a feature set, also called a "feature vector", is applied to the N inputs of the classifier, one of the M outputs 408 will have a larger value than the other outputs. The output with the largest value indicates the class the input belongs to.

The neural network is trained on the standard sounds, or presets, of the synthesizer. For example, the neural network is trained to differentiate between brass, woodwind, plucked, bell-like, and percussion classes of notes. When a new audio input segment is applied to the acoustic feature extraction unit 402, a feature vector 404 is computed and provided to the classifier 406. The classifier compares the feature vector against its library of learned presets and chooses the preset most similar to the feature vector. This preset is used by the synthesizer in transforming the sung input into an instrumental composition. For example, the classifier may choose between a trumpet, a guitar, or a bass drum, depending on how the composer sings his input. The choices of the classifier may be limited by the user selecting a particular instrument or family of instruments to classify the audio segment feature vectors against.

An example of a family of instruments is a standard drum set, which includes a bass drum, a snare drum, and a high hat. A user could sing a drum part of "boom-chicka-boom-chicka-boom". The previously described segmentation process would break this sound into the separate notes of "booms" and "chickas" and the acoustic feature extraction unit would provide the classifier with feature vectors for each note. The classifier would then identify the booms as a bass drum output and the chickas as a snare drum output. Note outputs would then be generated that are appropriate not only for the originally input note, but that are also appropriate for the identified instrument source. One feature of mapping the sung notes onto a library of instrumental notes is that the instrumental notes may include harmonic or subharmonic components characteristic of that instrument that lie outside the vocal range of the composer. Similarly, the composer could select an instrument that produces fundamental notes outside the vocal range, and a frequency shift or transpose could map the sung notes onto higher, lower, or more complex instrumental notes. Thus, the composer may create music with his voice that exceeds his vocal range.

The robustness of the classification technique depends on the number of classes that the feature vectors are evaluated against, and the differences between the input sounds. In the case of inputting booms and chickas, a very simple feature set, such as spectral centroid or maximum frequency at greater than −40 dBw, can robustly classify the different sounds. Accordingly, the classifier can evaluate different feature sets based on the allowed classes.

The classification process can be aided by the user providing information. Such information may make the classification more robust, quicker, or both. A user could specify an instrument, a class of instruments, or a type of track, such as percussion or melody. Such user selection could be made, for example, by clicking on a selection provided on a screen of a composer's assistant, by entering values through a keyboard, by pressing a button, or by speaking into the input and using speech-recognition technology. If a single instrument is selected, no feature extraction or classification would be necessary, and the audio segment would be mapped directly to the identified instrument library.

In the foregoing specification, the invention has been described with reference to specific exemplary embodiments. While the above is a complete description of the invention, it is evident that various modifications and changes may be made to the described embodiments without departing from the spirit and scope of the invention, and that alternative embodiments exist. For example, the input information could be provided from a source other than a human voice. Therefore, the invention is set forth in the appended claims and their full scope of equivalents, and shall not be limited by the specification.

What is claimed is:

1. A device for converting a vocal signal to an audio note, the device comprising:

an audio input device that receives the vocal signal and produces an analog electrical signal therefrom;

an analog-to-digital converter that converts the analog electrical signal into a digital electrical signal;

a memory containing a note output file having an instrument preset number;

a processor in electrical communication with the memory that separates the digital electrical signal into a plurality of segments and converts at least a segment to note information;

a synthesizer receiving the note information and producing a digital electrical output signal therefrom;

a digital-to-analog converter coupled to the synthesizer, the digital-to-analog converter converting the digital electrical output signal to an analog electrical output signal; and a speaker coupled to the digital-to-analog converter, the speaker producing an audio signal from the analog electrical output signal.

2. The device of claim 1 wherein the note output file includes an instrument preset number, a note number, and a note velocity.

3. The device of claim 1 wherein the note output file includes a note start time and a note end time.

4. The device of claim 1 wherein the processor separates the digital electrical signal into a plurality of segments based upon a combination of a plurality of transitions in a pitch trajectory and a plurality of amplitude variations in an amplitude envelope of the digital electrical signal.

5. The device of claim 1 wherein the processor further determines a pitch contour and an amplitude contour of the segment and generates a synthesis engine parameter set therefrom, the synthesis engine parameter set being provided to the synthesizer, the synthesizer using the synthesis engine parameter set and the note output to generate a modified digital output signal.

6. The device of claim 1 further comprising a second memory, the second memory configured to receive and store the digital electrical output signal from the synthesizer.

7. The device of claim 5 wherein the processor further determines a pitch waveform fundamental frequency, a pitch waveform amplitude variation, an amplitude waveform fundamental frequency, and an amplitude waveform amplitude variation of the segment to generate control information.

8. The device of claim 7 wherein the processor generates a low frequency oscillator control information.

9. The device of claim 1 wherein the memory contains an instrument library, the instrument library containing a plurality of preset files, each of the plurality of preset files containing a plurality of instrument-specific notes, and wherein the processor selects a preset file from the instrument library and an instrument-specific note from the preset file according to at least one of the plurality of segments.

10. The device of claim 9 further comprising an acoustic feature extraction unit, the acoustic feature extraction unit receiving the segment and generating a feature vector therefrom, and a classifier receiving the feature vector and producing an output class, the output class being provided to the processor to select the preset file.

11. The device of claim 9 wherein the plurality of instrument notes includes spectral frequency components above or below the vocal signal.

12. The device of claim 11 wherein the spectral frequency components are harmonics or subharmonics of a fundamental frequency of the segment.

13. A device for converting a vocal signal to a digital output signal, the device comprising:

an audio input device that receives the vocal signal and produces an analog electrical signal therefrom;

an analog-to-digital converter that converts the analog electrical signal into a digital electrical signal;

a memory containing a note output file;

a processor in electrical communication with the memory that separates the digital electrical signal into a plurality of segments and determines a pitch contour and an amplitude contour of a segment and generates synthesis engine parameters therefrom, and converts the segment to note information and selects a note output corresponding to the segment.

14. A device for converting a vocal signal to a digital output signal, the device comprising:

an audio input device that receives the vocal signal and produces an analog electrical signal therefrom;

an analog-to-digital converter that converts the analog electrical signal into a digital electrical signal;

a memory containing an instrument library, the instrument library containing a plurality of preset files, each of the plurality of preset files containing a plurality of note preset outputs;

a processor that separates the digital electrical signal into a plurality of segments and converts at least one of the plurality of segments onto the plurality of preset files to select a preset file, and to select a note preset output from the preset file; and a synthesizer receiving the note preset output and producing a digital output signal therefrom.

15. A device for converting a vocal signal to a modified output signal, the device comprising:

an audio input device that receives the vocal signal and produces an analog electrical signal therefrom;

an analog-to-digital converter that converts the analog electrical signal into a digital electrical signal;

a memory containing an instrument library, the instrument library including a plurality of preset files and audio waveforms, the waveforms being stored in a sound memory;

a processor that separates the digital electrical signal into a plurality of segments and extracts a feature set from at least one of the plurality of segments to select at least one of the preset files from the instrument library, and selects at least one of the audio waveforms from the sound memory, and, the processor determining a pitch waveform fundamental frequency, a pitch waveform amplitude variation, an amplitude waveform fundamental frequency, and an amplitude waveform amplitude variation of the at least one of the plurality of segments to generate low frequency oscillator control information and envelope generator control information;

a low frequency oscillator receiving the low frequency oscillator control information to produce a low frequency oscillator output;

an envelope generator receiving the envelope generator control information to produce an envelope generator output;

a synthesizer configured to receive the preset file, the audio waveform, the low frequency oscillator output, and the envelope generator output, and producing an output signal therefrom.

16. A method for converting a vocal signal to a digital note, the method comprising:

(a) providing a vocal signal to an audio input device to generate an analog input signal;

(b) digitizing the analog input signal to provide a digital input signal;

(c) processing the digital input signal to separate the digital input signal into a plurality of segments;

(d) processing a segment to determine a segment frequency and to extract auxiliary audio information;

(e) mapping the segment frequency to a note output file contained in a memory; and (f) synthesizing a digital note output signal according to the note output file and the auxiliary audio information.

17. A method for converting a vocal signal to a digital note, the method comprising:

(a) providing a vocal signal to an audio input device to generate an analog input signal;

(b) digitizing the analog input signal to create a digital input signal;

(c) processing the digital input signal to separate the digital input signal into a plurality of segments;

(d) processing a segment to determine a feature vector and pitch information;

(e) selecting a preset file from a plurality of preset files, according to the feature vector;

(f) mapping the segment to a waveform contained in the sound memory, according to the pitch information; and (g) synthesizing a digital note output signal according to the waveform.

18. A method for producing a multi-track audio composition, the method comprising:

(a) inputting a first audio track into a recording apparatus;

(b) digitizing the first audio track to create a first digitized track and storing the first digitized track in a buffer of the recording apparatus;

(c) identifying a queuing point of the first digitized track;

(d) processing the first digitized track; creating a plurality of segments;

(e) synthesizing note outputs based upon a subset of said plurality of segments;

(f) inputting a second audio track into the recording apparatus;

(g) queuing the first digitized track to the queuing point; and (h) digitizing the second audio track to create a second digitized track, the second digitized track being synchronized to the first digitized track, and storing the second digitized track in the buffer of the recording apparatus.

19. The method of claim 18 wherein (c) of identifying a queuing point is done automatically, the queuing point being a beginning of the first digitized track and occurring by the time the second audio track begins, the second audio track beginning at a time later than an ending time of the first audio track.

20. The method of claim 18 further comprising a step, prior to (c) of identifying a queuing point, of entering a marker in the first digitized track, wherein (c) of identifying the queuing point identifies the marker as the queuing point.

21. A computer program product for converting a vocal input into a digital output signal, the computer program product comprising:

a computer-readable storage medium; and a computer-readable program embodied in the computer-readable storage medium, the computer-readable program comprising:

a first set of instructions for segmenting an audio input into a plurality of segments, a second set of instructions for determining a pitch contour of a segment, a third set of instructions for mapping the pitch contour to a first synthesis engine parameter and for outputting the first synthesis engine parameter to a buffer, a fourth set of instructions for mapping the segment to a note number, a fifth set of instructions for determining an amplitude contour of the segment, a sixth set of instructions for mapping the amplitude contour to a note-on velocity, a seventh set of instructions for selecting a note output from a preset based on the note number and the note-on velocity and for outputting the note output to the buffer, an eighth set of instructions for mapping the amplitude contour to a second synthesis engine parameter and for outputting the second synthesis engine parameter to the buffer, and a ninth set of instructions for combining the first synthesis engine parameter, the second synthesis engine parameter, and the note output to produce the digital output signal.

* * * * *